US006035847A

United States Patent [19]

Paul

[11] Patent Number: 6,035,847

[45] Date of Patent: Mar. 14, 2000

[54] EASILY IGNITED FILLER FOR CANNED HEAT CONTAINER

[76] Inventor: Dennis Duane Paul, P.O. Box 4733, Boynton Beach, Fla. 33424-4733

[21] Appl. No.: 09/298,010

[22] Filed: Apr. 22, 1999

[51] Int. Cl.[7] ..... F24C 5/00

[52] U.S. Cl. ..... 126/43; 126/45; 431/320; 431/325

[58] Field of Search ..... 126/43, 45; 431/320, 431/298, 325

[56] References Cited

U.S. PATENT DOCUMENTS 2,829,511 4/1958 Oesterle et al. ..... 431/325
2,912,742 11/1959 Choate ..... 431/325

*Primary Examiner*—Carroll Dority

[57] ABSTRACT

A portable or canned heat product is made where a liquid fuel is added to a filler made of bicomponent curled fibers with the fibers substantially oriented such that the axes of the fibers are parallel to the axis of a container holding these fibers and this filler and fuel provides an easy to ignite wick free heating device and a method to make ignition of a fiber surface easier.

13 Claims, 2 Drawing Sheets

FIGURE 3
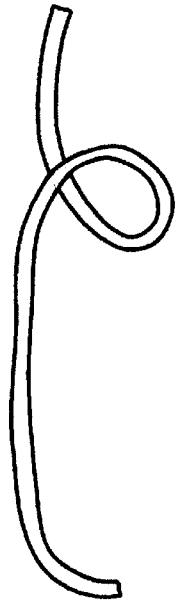
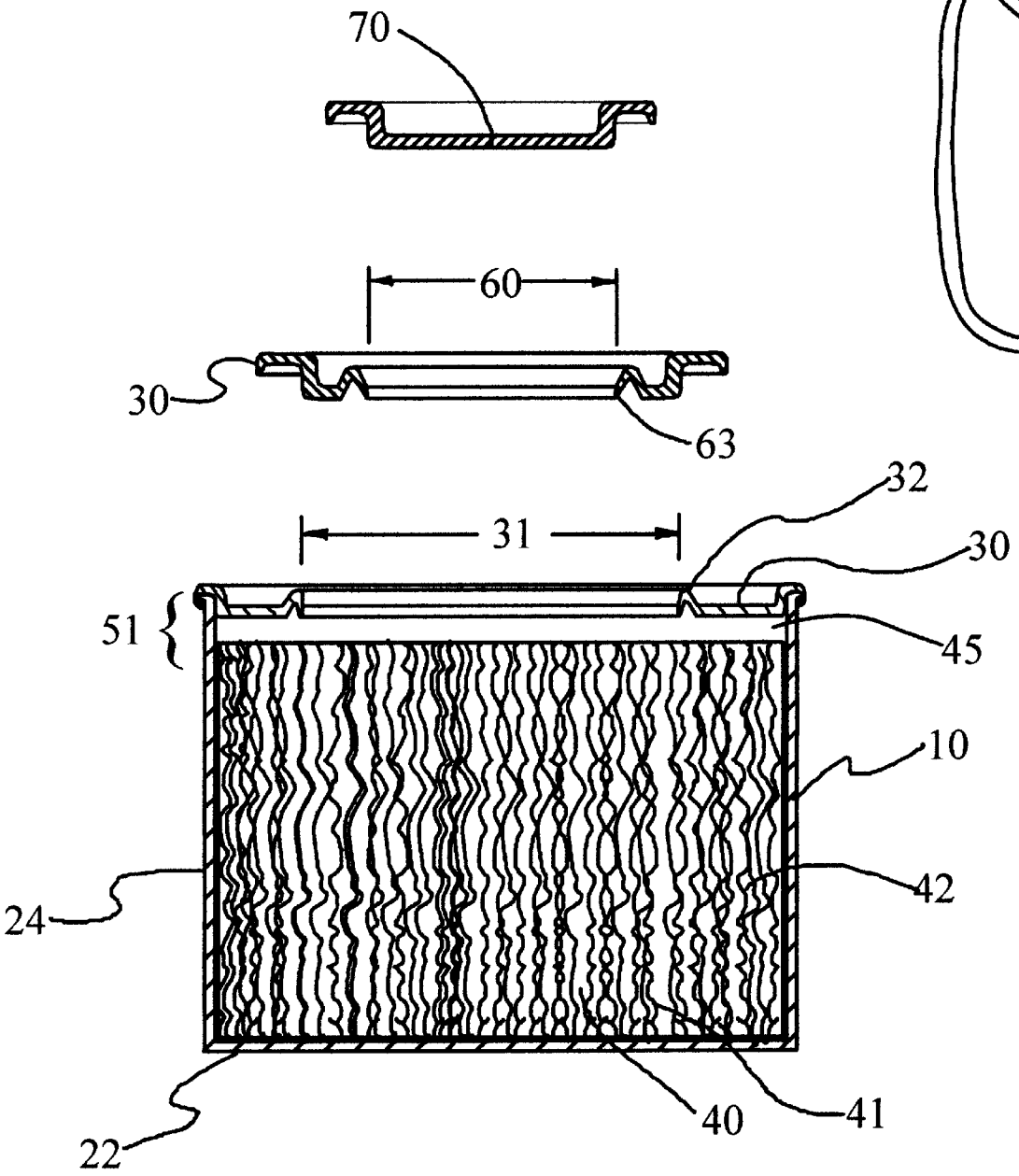
FIGURE 4

EASILY IGNITED FILLER FOR CANNED HEAT CONTAINER

FIELD OF INVENTION

This invention relates to portable heat sources using flammable materials packaged in non-burnable containers, specifically canned heat products consisting of fuel and a filler contained within a non-burnable container easily lightable without wicks and more efficient in total combustion due to a bicomponent curled wicking filler.

BACKGROUND AND PRIOR ART

Canned heat products, most notably Sterno, a trademarked product consisting of a gelled alcohol mixture, are common. The products roots lie in antiquity as many candle and lamp heaters existed back to the shell shaped lamps of prehistory burning fats and vegetable oils.

The most recognizable product in the category of portable heating sources is a can of sterno, a popular alcohol based source of flames that consists of a gelled mix including a high proportion of alcohols which are easy to ignite and burn readily.

The Sterno product produces a sheet of flame across the surface of the container that holds the flammable gel, and this sheet flame, unlike a wicked candle, provides a large flame area and a correspondingly large heat output.

The increasingly restrictive rules on shipment of flammables has created a need for products that can burn like the Sterno product, but which are safe to ship. This means that the product must have a high flash point.

The use of portable fuel cans such as the above mentioned Sterno product is widespread for campfire replacement, for buffet warming duty, for hot service pans, fondue heating and innumerable other applications where localized heat or warming is needed. The Sterno type cans, since they are useful and have long been desirable in consumer and food service markets have been the subject of a number of prior patents. Examples of portable burners are U.S. Pat. No. 4,725,225 (Grabitt); U.S. Pat. No. 3,042,108 and U.S. Pat. No. 3,290,907 Boij et al); U.S. Pat. No. 4,624,633 (Bandel); and U.S. Pat. No. 3,516,774 (Livingston). These designs are all wick based and use either a true wick or other materials that act as a wick to provide a hot surface that vaporizes the barely burnable materials making them easily ignited.

As noted in comments on candles above, even with large bundles of fibers acting as a wick, the burning area is severely constrained by the wick size. A Can width wick would deplete the fuel reservoir very quickly and defeat the need for long lasting heating. Wicks are a problem and there is a need for a sheet of flame over the surface of a container that wicked devices in prior patents cannot create.

The wick also typically is used not as in candles but with a liquid fuel that is readily wicked up the wick to the flame front area. When liquid fuels are used, the container seal is critical in shipping since there is a possibility of fluid leakage, and the possibility of accidents due to spill of contents during use is a real problem. There is a need for a liquid fuel storage and transport method and a device that prevents spillage of liquid fuels.

The solution to the wick type problems have been variations on U.S. Pat. No. 4,850,858 (Blankenship et al) where a liquid fuel was turned into a gel which would support flame across its entire surface without a wick and still was not fully fluid. As heat is applied, the gel melts and becomes fluid and is still prone to spillage. In addition the gel components being a small part of the total composition do little to make the alcohol rich gel shippable. If the retardant elements or non-burnable elements in the gel were increased to the point where the gel was safe to ship and spill resistant, the flame would be sufficiently reduced to render the heater ineffective. There is a need for a gel like material that is sufficiently flammable and safe to ship.

The gel type burners also create other safety problems. They can flash or explode as they are ignited due to vapor above the surface of the gel layer, and they burn down causing eventual heating of the can, and persons touching the can of partly burned, liquified gel may react to this hot surface and drop the container thus causing fires of other problems. Safety requires a better flame type container for heating purposes.

Another way around the Sterno type gel problem is to find a material that is flammable enough to burn in sheet fashion across the entire surface of a container but which is a semisolid or at least viscous enough to have a flash point that is acceptable for shipping. Generally the problem of gasification of the viscous material without a wick or extended surface prevents sheet burning of such materials. U.S. Patent applications have been filed for specific materials, the manufacture of units in the Bahamas and sale in the United States in 1989 and 1990 of such products as are covered in the Levinson Patent (U.S. Pat. No. 5,193,521). These early manufactures used both blends and nonblended glycol materials with mineral wool or glass fiber fillers.

One application by Levinson was for a particular blend of 16 parts of diethylene glycol and one part of isoparaffin that partially cures this problem. The presence of over 94% of the viscous material and only around 6% of the much more flammable isoparaffin which is subject to restricted shipping and is normally a liquid lowers the flash point of the mixture sufficiently to allow shipping of the mixture without restrictions. Despite the lowered flammability, this mixture does burn in sheet manner and thus does provide a satisfactory heat source when in a container. The inventor of this mixture found that the diethylene glycol by itself could not be ignited without the presence of an intermixture of the flammable liquid. Unfortunately the diethyleglycol and the isoparaffin materials were non-miscible and thus separated to form separate layers which defeated the purpose of the invention.

Common uses for canned heat products are as heaters in chafing dishes and food service applications in hotels and food service and buffets as well as in camping, backpacking and wilderness uses where compact heaters and stoves are required.

One very common product that illustrates the complexity of canned heat products and the problems they have is shown in U.S. Pat. No. 5,307,799 to Scarnato et al. This product uses a fuel, diethylene glycol, which is hard to ignite. There were a series of approaches to making this product ignitable, one involving the mixing of two fluids, one at lower concentration which is easier to ignite and a second, consisting of a majority of the fuel, which was less ignitable. This concept was only partly successful and later a concept of a pool of more flammable material wicked through a bed of fibrous material impregnated with less flammable fluids was patented. This Patent requires a wick, a bed of fiber, and separate addition in succession of two different measured alloquats of fluids. The resulting manufacture is difficult.

The reason that one material wicks well and another does not is poorly understood. The concept of wicking requires wetting of a surface, a fluid that is relatively low viscosity, a group of surfaces that are near each other or in partial (but not full) contact, and the ability of the fluid to form a meniscus (wet a surface) and also seems to relate-to the roughness of the surface. The ignition of the surface to form a flat film flame at the surface is also poorly understood but it requires at least the foregoing factors and others not defined.

DESCRIPTION OF INVENTION

As noted above, one type of canned heat product consists of a outer container filled with a fibrous material impregnated with flammable materials. In current technology, the surface of the fibrous material exposed at the top of the outer container is very difficult to ignite unless the fluid within the fiber layer is very flammable. The amount of fuel utilizable is dependent upon the wicking action of the fibrous material, with currently available materials permitting only partial burning of the fuel. As a result fuel is discarded as well as the fiber material and the can. The fuel can create ecological problems in disposal and causes concerns about safety of disposal.

A type of fiber has been developed that consists of two layers each at least a substantial portion of the thickness of the fiber (as opposed to mere coatings) where each layer has a coefficient of expansion that is different. The fibers are manufactured into individual fibers at molten temperatures for the two glass or mineral layers. As the fibers cool, the difference in expansion causes the fibers to curl into loose coils of fibers. The coiled fibers have proven significantly better in areas such as insulation and industrial heat shields since they can be finer in diameter and yet fill more space because of the coiling.

The new coiled fiber has been found to also offer significant improvements as fill within a canned heat product in allowing essentially all of the fuel to be burned and in allowing easy relighting on the exposed surface of the canned heat product. While capillary action explains some of the fuel conveying efficiency, the reason for ease in relighting is currently unknown and is speculative.

This invention utilizes this new fibrous material to provide easy ignition of a low volatility (low flammability) material without need for blends or igniters in a canned heat product consisting of a fibrous bicomponent glass or mineral fiber which curls due to differing coefficients of expansion between the differing layers within the glass or mineral fiber which substantially fills the container of a canned heat product without need for an ignition device.

THE MECHANISM OF CAPILLARITY—Capillary action or capillarity is an effect of surface tension. It is the ability of a liquid to rise inside narrow tubes in apparent violation of the force of gravity. If a narrow tube is inserted into a reservoir, the water rises within the tube and the surface of the liquid will show a concave shape. The water climbs the surface of the tube until the upward pull of the surface tension is balanced by the weight of the water column.

The rise of a fluid within a tube is determined by the relative strengths of the cohesive force between the molecules in the liquid and the adhesive forces between the liquid molecules and the molecules that make up the surface of the tube. Large adhesive forces "wet" the tube material and the liquid will rise. As the liquid is more effective in wetting the surface of the tube, the angle between the tube surface and the liquid is very small, as the angle gets higher, the cohesive forces are larger in relation to the adhesive forces and the liquid does not effectively wet the surface of the tube and the liquid level rise will be less.

A bundle of fibers acts much like tubes. A bundle of fibers is most densely packed when they are arranged in a vertical bundle as shown if FIG. 1 of the Drawings. The voids between the fibers in such a densely packed media act like tubes and the voids between the fibers act as capillary columns (tubes) when in contact with fluids. Due to Newtons Laws of Motion, the wetting fluid will rise within the column until the weight in the column equals the adhesive force between the liquid and the fibers. The adhesive force between the liquid and the fibers is given by equation 1

$$F=\sigma l_c \cos(\theta_4) \tag{1}$$

Where sigma is the surface tension of the fluid, 1 is the arc length of the cross section of the column, a theta is the contact angle between the fluid and material of the fiber. The weight of the fluid in the column is given by:

$$F_g=\rho g A_c h_c \tag{2}$$

Where rho is the density of the fluid, g is the gravitational constant, $A_c$ is the cross section of the column and $h_c$ is the height of the column.

The cross sectional geometry of a column formed by three fibers is shown in FIG. 2. The centroids of the circles representing the fibers form the verticies of an isosceles triangle with the length of one side equal to 2r where r is the radius of the fiber.

Each of the three arcs forming the column cross section extends through $\pi/3$ radians and the arc length of the column cross section is given by:

$$1=r_f\pi \tag{3}$$

For fluids that wet surfaces well, theta is close to zero and cosign theta is near unity. Substituting (3) into (1) with cosign theta as 1 results in $$F_A=\sigma r_f\pi \tag{4}$$

The cross sectional area of the column is the area of the triangle less the area occupied by the fibers giving:

$$F_c=\rho g r_f^2(3^{0.5}-\pi/2)h_c \tag{5}$$

and solving for h this yields $$h_c=\pi\sigma/(\rho g r_f(3^{0.5}-\pi/2)) \tag{6}$$

substituting the normal gravitational constant of 981 cm/sec, and for a material such as diethylene glycol $\sigma$=+44.7 dynes/cm and $\rho$=1.118 g/cm$^3$ into the formula above yields $h_c$=794 cm.

The above showing that capillarity should rise to 794 cm is based upon the assumption fibers were very densely packed to the point of touching. In reality, fibers may not be touching, may not be in contact, and the column effective diameter may be much larger than the above example.

Equation 6 shows that column height is linearly proportional to the inverse of fiber radius. That means that if effective fiber radius is doubled the column height is halved.

PROBLEMS WITH THE THEORY OF CAPILLARITY—Common sense and repeated experiments show that the packing factors assumed in the brief discussion of capillarity do not exist. In products such as canned heat, several factors fight each other and result in drastic diminuation of the capillary action. The high packing factor effectively cuts the volume of fluid available. Since long burn times are important factors in success of a canned heat product, the filler fiber tends to be much looser than the model and the capillarity produces total column heights of 2 to 5 inches.

Due to the rather loose fill used to insure a balance between the fluid volume within a given size container and the wicking or capillary action of the filler, an additional problem frequently arises—incomplete emptying of the container when it burns. This is due to a breakdown of the capillarity prior to the removal of the bottom layers of the fluid in the container. In essence the capillarity has a column height less than the height of the filler so the top of the fill has no conveyed fluid prior to the emptying of the container.

FUEL SELECTION—The present invention is a major step toward improved safety in fuel fed sheet burning heater containers. The use of ethylene Glycol based materials which burn clean and can support sheet burning in the past had to be assisted by the provision of an igniter which consists of a flammable material injected below the surface of the glycol material where it has no flash point contribution to the surface and the provision of a fibrous igniter cord that wicks the flammable material to a point where it starts the less flammable glycol material (see Levinson and Scarnato Patents).

The mere provision of an extended fibrous material which will not readily burn would not provide adequate ignition and burning of the glycol material at the surface of the heater container.

Ethylene glycol itself is not a good material for the burner since it remains fluid. When the ethylene glycol is reacted to form either diethylene glycol, triethylene glycol, or tetraethylene glycol, all of these being relatively viscous, being classed as non-flammable for shipping purposes, and yet can be ignited to form sheet burning on the fibrous base. The similar methylene glycols are also anticipated as effective burnable materials in this application.

The reacted ethylene glycol materials have a problem, they are hard to ignite although they do burn well once ignition is complete.

In the present invention, a bicomponent fiberglass or similar non-burning material which is curled along an axis parallel to the fiber length which is formed by extrusion or spinning of fibers with adjacent layers that each are a substantial part of the thickness of each fiber but which have a different coefficient of thermal expansion, is inserted into a container which is subsequently filled with a liquid such as a substituted glycol to make a canned heat product. The inserted fibrous bundle, aligned such that the axes of the curled fibers are parallel to the axis of the container and the ends of the fibers form a wick across the entire width of the exposed surface of the fiber bundle. This integral wick surface provides transport of the flammable materials to the surface of the container where sheet flame can be started. The integral wick is easily ignitable for reasons that are speculated upon below.

The first consideration in the ease of lighting is the expected enhancement in the capillarity of the fiber bundle due to the angle of the curled fibers to the axis of the container. The angled fibers (which are angled due to the curl) have spaces between the fibers that to an observer looking along the axis of the container have changed the tubular shape to a oval shape due to this tilt so that the apparent width of the space between the fibers is smaller and the smaller column thus is more effective in conveying the fluids by capillary action. The curl may in itself act as an ignition promoter in that it may provide both capillarity and spaces in the center of bundles of curled fibers where the edges of the curls may be ignited and the fuel may be easily gasified. Differing materials due to the bicomponent nature of the fiber or roughness due to the interface between layers may also help ignition. It further may be that fiber bundles at angles are inherently easier to ignite. While these reasons may indicate the mechanism of the better transport and ignition of curled bicomponent fibers, there is no proven reason for the vast improvement in the performance using this new fiber material.

The fibrous materials in the container serve dual purposes. The fibers act as reinforcing materials which stiffen the viscous reacted glycols and prevent flow within the container and the fibrous materials also act to support the burning thus improving the ignitability of the reacted glycols and improve the sheet burning. The fibrous materials fill the containers to within ¼ inch of the top although it is merely essential that the container be substantially filled. In use the Fibrous mass acts like an extended burn surface with the vacuum of the burning depleting the surface area of the reacted glycols drawing up more of the reacted glycols where they can burn. It is noteworthy that the fibrous mass acts in part by capillary action, and since the fibrous mass is not a closely arrayed fiber bundle the action is different and more scattered than that of a wick. This scattered action provides for a more uniform sheet flame as opposed to that centered around a small discrete wick since a wick over the entire surface of the container would causes a more effective burn rate.

The manufacture of this heating container is especially easy since the materials used, unlike the methyl alcohol based materials often used are harmless. The reacted glycol has excellent safety and toxicity ratings. The containers may be of any non-flammable material but coated or uncoated steels or aluminum are effective since the materials used are non-corrosive and actually protective of the metal containers. The biggest hazard in manufacture of filler based canned heat products was the carcinogenic of the fine fibers of rock wools but fiberglass and the bicomponent materials are expected to be less harmful.

The manufacture can add a fibrous mat shaped to fit the container to the container, then the container may be filled with reacted glycols. The glycols which are filled hot to enhance flows, solidify around the fibrous material mat.

DESCRIPTION OF DRAWINGS

FIG. 3 shows typical curled fibers and the axis around which they curl.

FIG. 4 shows a cross sectional view of the portable heating container where part of the fibrous mat is visible.

DESCRIPTION OF PREFERRED EMBODIMENTS

Figure 1:
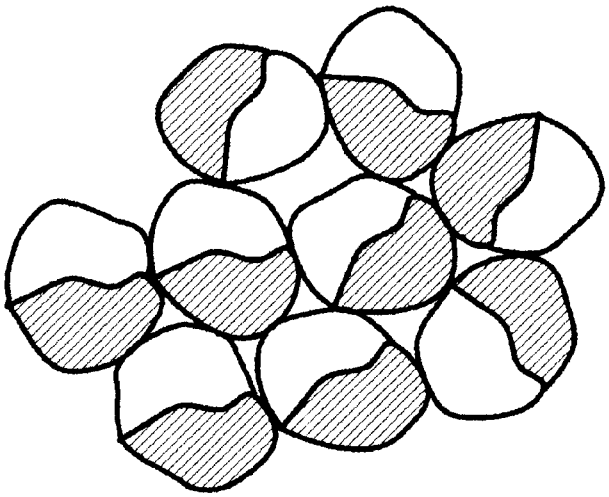
FIG. 1 is a view of the portable heating container fibers in closely packed array.
Figure 2:
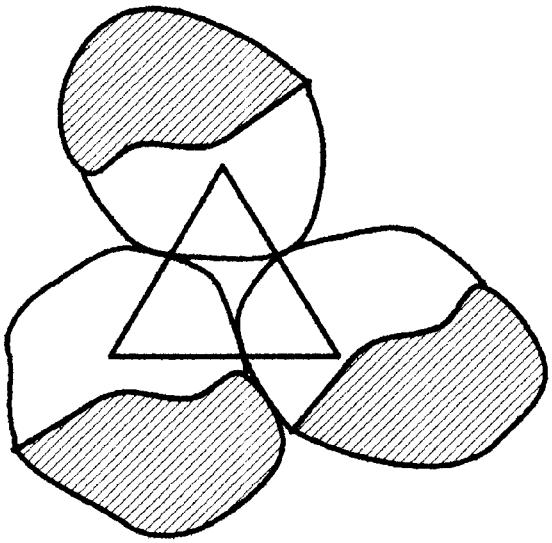
FIG. 2 is a cross sectional view of the fibers showing the capillary column within a three fiber array.

The preferred embodiment of this portable heating container as shown in FIG. 4 contains the container, indicated by 10 which has a base 22 with integrally formed side walls 24 extending upwardly from the base. The container elements are formed from steel or aluminum and in this, most preferred embodiment, are integral without seams which could cause leakage.

The container has a top 30 with a large centrally disposed circular opening of a diameter 31 which is an annulus, formed in the top and which includes a protruding ridge 32 around said centrally disposed opening such that the ridge extends around the periphery of the opening. This top is attached by normal metal or can forming means 33 to the container.

Looking at FIG. 4, an inside chamber 40 is formed by the base, side walls and the annular top part. A fibrous material 41 which is the curled bicomponent nonflammable fiber of this invention is placed within the interior chamber such that it extends to near the top of the chamber. A distance of ¼ inch spacing from the top of the fibrous filer to the bottom of the annular top, has been shown effective for containers of 3 to 4 inch diameters and 2½ inch height. The space between the fibrous material and the annular top part becomes the combustion chamber of this device 45. The heating fuel 42 is added to the inside container by pouring the fuel into the container to the level of the top of the fibrous material, this heating fuel being a reacted glycol, especially diethylene glycol. The diethylene glycol tends to cling to the fibrous mat to form a semisolid mass.

The container is then sealed with top element 63 which is a further annular ring which fits within the protruding ridge in the top and fictionally engages this ridge on the outer surface of the annulus at diameter and forms a smaller exposed area 60 in the center of the top of the container ringed by a second protruding ridge which restricts the exposed surface of the fibrous material and heating fuel. A further top 70 is used to complete the top cover of the container, which fictionally engages the second protruding ridge of annulus 61 to form a seal.

In use, the container lid 70 is removed. If high heat is desired annulus 63 is also removed, it is left in place if low heat is desired. A match or lighter is used to ignite the readily ignited surface of the fibrous bicomponent fiber. As the heating fuel continues to burn, it is drawn by vacuum and wick action to the top surface of the container where it burns in the open area where atmospheric oxygen provides the oxidizer needed for burning.

In a second embodiment, the annular ring 63 is omitted and top 70 is increased in diameter to engage the protruding ridge 32 and form a seal which results in a one output portable heating container.

In a third embodiment, the entire top annular ring is removed and a sealing top covers the entire top surface of the container providing a single output and a maximization of the exposed heating fuel/fibrous material surface which creates a high heat device.

I claim:

1. A portable heating device where a container consisting of a bottom and side walls which is substantially filled with a fibrous material and reacted glycols, where said fibrous material is curled fiber aligned such that the central lengthwise axis of said fiber is aligned with the axis of said container and where said fiber is curled around said lengthwise axis through manufacture with bicomponent layers which have differing coefficients of thermal expansion.

2. The claim in 1 where said reacted glycols are di-ethylene Glycol, tri-ethylene glycol or quad-ethylene glycol or substituted methylene glycols.

3. The claim in 1 where said fibrous material is bicomponent glass fibers.

4. The claim in 1 where said fibrous material is a rock wool filler made with dual layers of differing coefficients of thermal expansion.

5. The claim in 1 where said container has a top and the size of the top is varied to provide differing amounts of surface exposure.

6. A device for portable heating where semisolid or solid fuels are supported within a mat of non-burnable fibers, and where the gasification of said semisolid or solid fuels is enhanced by provision of a more readily ignitable surface made of fibers which are curled along their length around a central axis.

7. The claim in 6 where said reacted glycols are di-ethylene Glycol, tri-ethylene glycol or quad-ethylene glycol or methylene glycol or propylene glycol.

8. The claim in 6 where said curled fibers are fiberglass and said curl is caused by making said fibers from two layers each of which has a different coefficient of thermal expansion.

9. A shippable container for heating which contains a reacted glycol fuel which is not classed as flammable for shipping purposes embedded within a fibrous mat consisting of non-burning curled bicomponent fibers that contains liquids that are flammable trapped below the surface providing non-flammable class of shipping of said reacted glycol fuel while allowing said fluid wicked to the surface of said reacted glycol fuels to be easily ignited by igniting means.

10. The claim in 9 where said reacted glycols are di-ethylene Glycol, tri-ethylene glycol or quad-ethylene glycol.

11. The claim in 9 where said reacted glycols are dipropylene glycol or di or tri methylene glycol.

12. The claim in 9 where curled bi-component fibers are fiberglass fibers with different compositios of glass in each layer which have different coefficients of thermal expansion.

13. A method to enhance burnability of diethylene glycol, triethylene glycol or quadethylene glycol which are reacted glycols where said reacted glycols are supported on a mat of non-burnable curled fiberglass fibers which wick liquified reacted glycols and enhance the burnability of said reacted glycols on the surface of said mat which is normal to the axes of said fibers.

* * * * *